US005323538A

United States Patent [19]

Sutterlin

[11] Patent Number: 5,323,538

[45] Date of Patent: Jun. 28, 1994

[54] DEVICE FOR PUNCHING HOLES IN ARTIFICIAL FINGERNAILS

[76] Inventor: Karl Sutterlin, Mechanische Werkstatt Luzernerstrasse, CH-6016 Hellbuhl, Switzerland

[21] Appl. No.: 773,580

[22] PCT Filed: Jan. 9, 1991

[86] PCT No.: PCT/CH91/00005

§ 371 Date: Nov. 7, 1991

§ 102(e) Date: Nov. 7, 1991

[87] PCT Pub. No.: WO91/10543

PCT Pub. Date: Jul. 25, 1991

[30] Foreign Application Priority Data

Jan. 12, 1990 [CH] Switzerland ..... 106/90

[51] Int. Cl.[5] ..... B26F 1/00; B26F 1/14; B26F 1/32

[52] U.S. Cl. ..... 30/366; 30/367; 30/368

[58] Field of Search ..... 30/366, 367, 368; 132/75.4; 173/206; 604/218

[56] References Cited

U.S. PATENT DOCUMENTS

| | | | |
|---|---|---|---|
| 1,161,684 | 11/1915 | Ireland | 30/368 |
| 1,631,175 | 6/1927 | Winkler | 30/368 |
| 2,540,782 | 2/1951 | Hansen . | |
| 2,679,044 | 5/1954 | Bacon et al. | 173/206 |
| 2,708,972 | 5/1955 | Park | 30/367 |
| 3,120,143 | 2/1964 | Kreider | 30/366 |
| 3,391,460 | 7/1968 | Moore | 30/366 |
| 4,069,586 | 1/1978 | Skelton | 30/366 |
| 4,807,367 | 2/1989 | Loerwald | 30/367 |

FOREIGN PATENT DOCUMENTS

| | | |
|---|---|---|
| 2719378 | 6/1978 | Fed. Rep. of Germany . |
| 2168920 | 7/1986 | United Kingdom . |

*Primary Examiner*—Richard K. Seidel
*Assistant Examiner*—Paul M. Heyrana, Sr.
*Attorney, Agent, or Firm*—Speckman, Pauley & Fejer

[57] ABSTRACT

A device for punching holes in artificial fingernails comprising a piston-cylinder unit having a cylinder wall with an aperture in it extending across the whole of the cylinder. The aperture is banana-shaped in cross-section and wider than the internal diameter of the cylinder with the convex side of the aperture facing the piston. The pointed end of the piston has a sharp knife-edge. The hole punch is operated by holding it between the thumb and index and middle fingers and pressing, causing the pointed end of the piston to travel past the curved cylinder-wall aperture in which the artificial fingernail to be perforated has been placed.

20 Claims, 4 Drawing Sheets

DEVICE FOR PUNCHING HOLES IN ARTIFICIAL FINGERNAILS

BACKGROUND OF THE INVENTION

1. Field of the Invention

This invention relates to a device for perforating artificial fingernails.

2. Description of the Prior Art

Artificial fingernails are offered in an enormous variety of different shapes, colors and sizes by the cosmetic industry. They are glued onto natural nails and are intended to add to the well-groomed appearance of the fingers of the wearer. As a rule, artificial fingernails are intentionally long and extend by about 5 to 15 mm beyond the fingertips. Artificial fingernails are known, which are made of transparent plastic and enclose a magnifying glass, made of one piece from this plastic material, in the tip of the fingernail. Such a magnifying glass acts as ornamentation and can also be used as a reading aid. It is also known to wear expensive and real jewelry as ornamentation on the tips of the artificial fingernails. Up to now, pieces of jewelry were glued to the nails. However, gluing requires much effort and there is the danger that the connection might not hold and the piece of jewelry become lost. For this reason, the inventor recently has developed jewelry which can be inserted into a prepared hole in the fingernail. However, fingernails with factory-made prepared holes have a problem created by painting them, due to the capillary action of the nail polish, crust appear at the edges of the hole which, make the later insertion of the piece of jewelry more difficult and, tear the nail polish when the piece of jewelry is inserted. And, because the wearer would prefer to paint the artificial fingernails in a color which is coordinated with the rest of her makeup or her clothing, painting the nails will be done at home. In view of this problem, it is best to provide holes in the nails after they have been painted. This creates a clean edge around the hole, so that insertion of the piece of jewelry can take place without trouble and without damaging the polish.

SUMMARY OF THE INVENTION

It is therefore the object of this invention to provide a device which perforates an artificial fingernail, so that a suitably shaped piece of jewelry can be inserted in the resulting hole.

This object is attained in accordance with this invention by a device for perforating artificial fingernails comprising a piston-cylinder unit, where the wall of the hollow cylinder has a transverse aperture which is banana-shaped in cross section, convexly curved in relation to the piston, extends through the entire hollow cylinder, is wider than the interior diameter of the hollow cylinder and, the tip of the piston has a sharp edge honed into a knife.

BRIEF DESCRIPTION OF THE DRAWINGS

This invention will be understood in the drawings, and detailed description below, wherein.

DESCRIPTION OF PREFERRED EMBODIMENTS

Figure 1A:
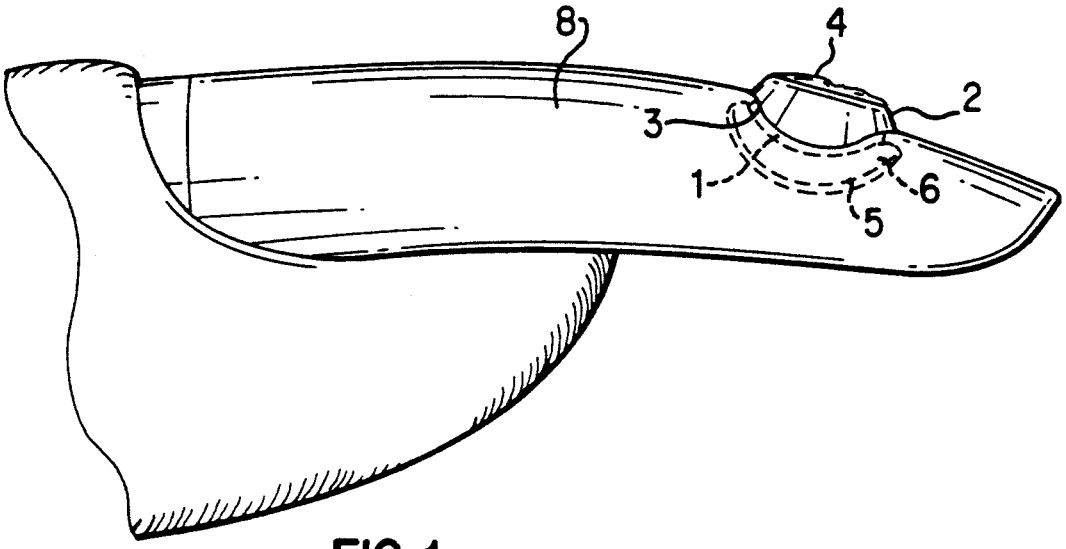
FIG. 1*a* is a side view of an artificial fingernail with an inserted piece of ornamentation.
Figure 1B:
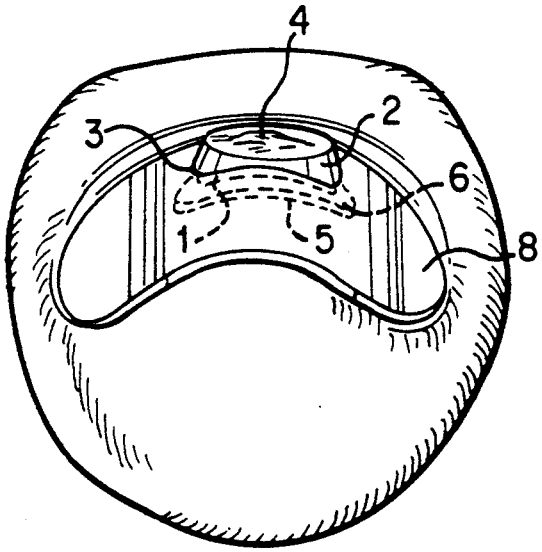
FIG. 1*b* is a front view of an artificial fingernail with an inserted piece of ornamentation.

An artificial fingernail 8 with an inserted piece of ornamentation is shown in FIGS. 1*a* and 1*b*. An ornamental insert is inserted into a prepared hole in the fingernail 8. It is pushed with its top from below through the hole in the fingernail 8. Because it has upper and lower edges 3, 6, between which a groove 7 is formed, the ornamental insert is securely maintained in the hole. Most often the ornamental insert is placed in the fingernail 8 of the little finger, because it is least stressed there and the fingernail 8 of the little finger is the most dainty. It is of course also possible to manufacture ornamental inserts in which the curvature of the edge is greater, which are then suited for insertion into the more flatly shaped fingernails of the other fingers, even the thumb. The edges 3, 6 of the top 2 and the foot 5 of the base of the ornamental insert follow the curvature of the fingernail 8 as a result of which the ornamental insert is securely kept in the nail hole. A cylindrical base 1 is located between the top 2 and the foot 5 of the base, the diameter of which exactly fits into the hole in the fingernail 8.

In accordance with another embodiment, the ornamental insert can also be in the form of a magnifying glass. Its upper part as well as the base and foot of the base are hollow cylinders having a central bore into which a small magnifying glass is inserted. On the one hand, this functions as an ornament, the top forming a nicely ornamented edge for the magnifying glass. On the other hand, the magnifying glass may be of help in making out small print. In this case it is only necessary to run the appropriate finger along the text and the letters can be seen enlarged through the magnifying glass.

The difficulty which this invention is intended to overcome is placement of a hole of an exactly determined diameter as accurately as possible in an artificial fingernail, where the fact that the fingernail is cambered must be taken into consideration.

Figure 2:
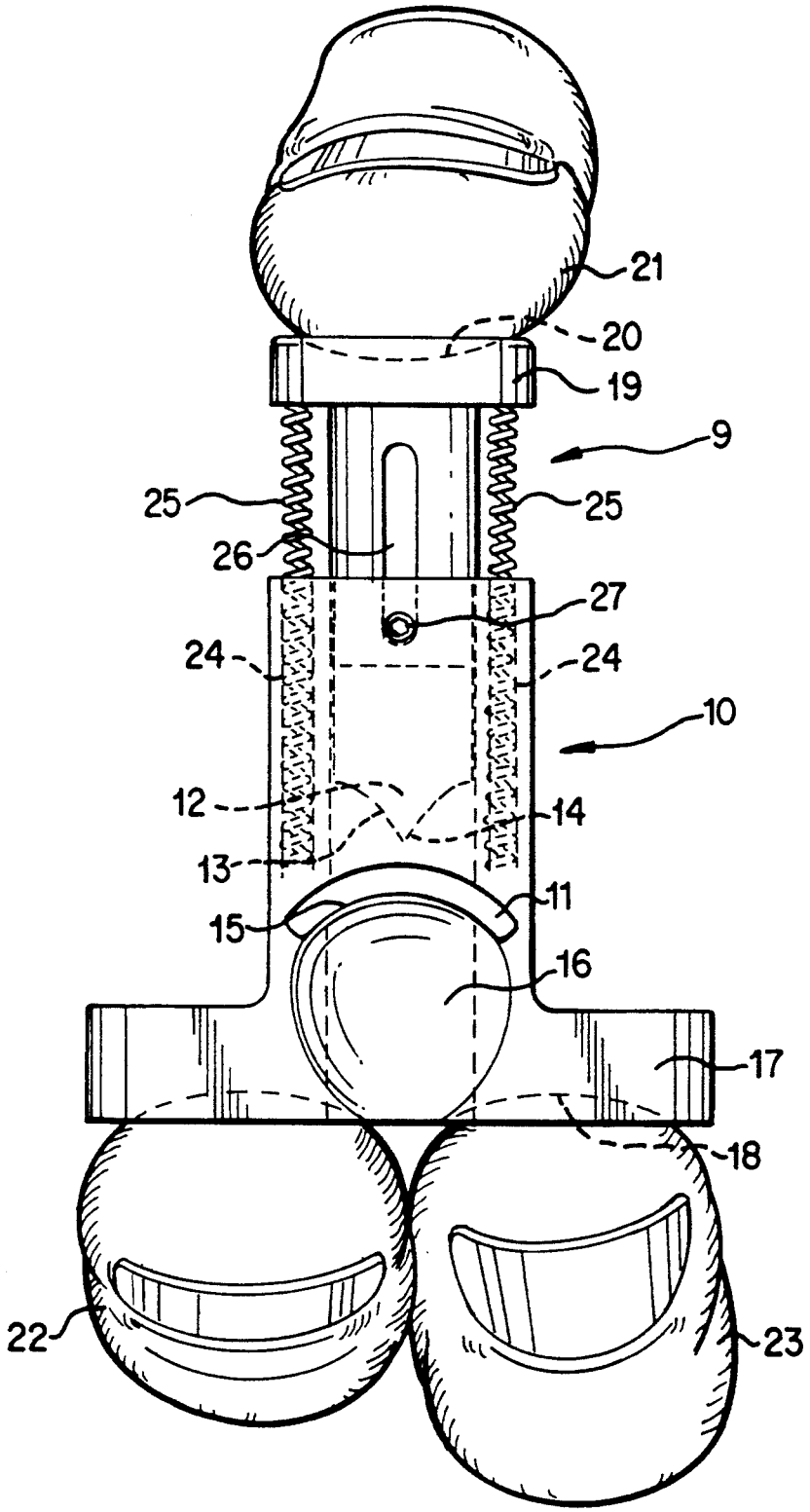
FIG. 2 is a diagram of a front view of a perforating device in accordance with one embodiment of this invention.

FIG. 2 shows a front view of a perforator, for making such a hole in accordance with one embodiment of this invention the piston is designated by reference numeral 9, and the hollow cylinder by reference number 10. In accordance with one embodiment of this invention, piston 9 is made of plastic and fits with its diameter into the hollow cylinder 10, so that it is properly guided in it. A head 19, the upper side 20 of which is concave, radially protrudes on all sides over the upper end of the piston 9. The tip 12 of the piston comprises a pipe section made of metal which is pushed over the slightly tapering end of the plastic piston. It has a sharp edge 13 honed into a knife. This edge 13 forms a curve similar to two connected S-curves along the periphery of the point of the piston. The two tips 14 formed by this are located diametrically opposite each other. In its lower area, the wall of the hollow cylinder 10, which advantageously is made in one piece of plastic, has a transverse aperture 11 with a banana-shaped cross section, convexly curved in relation to the piston 9, extending through the entire hollow cylinder 10, and which is wider than the interior diameter of the hollow cylinder 10. This transverse aperture 11 receives the fingernail to be perforated. The curvature 15 of transverse aperture 11 approximately corresponds to the transverse curvature of the fingernail in the area to be perforated. The side wall of the hollow cylinder is concavely formed in the area 16 below the transverse aperture 11. Artificial fingernail to be perforated is first glued to the natural fingernail and then pushed into the transverse aperture 11 so that the fingertip comfortably rests in the concave area 16. On its underside, the hollow cylinder 10 has a base 17 which protrudes beyond the hollow cylinder 10 in a radial direction. The underside of the base 17 has two concave indentations 18 which give support to the fingers 22, 23 for holding the perforator. The perforator is operated in such a way that the thumb 21 of the operating hand presses on the head 19 of the piston 9, while the index finger 22 and middle finger 23 of the same hand hold the base 17 of the hollow cylinder 10. In the view shown in FIG. 2, the thumb 21 and the index finger 22 and middle finger 23 of the right hand are indicated. In this case, fingernails of the left hand are perforated. Conversely, if the left hand grasps the perforator in the same way, the nails of the right hand can be perforated. Diametrically opposed blind bores 24 are present in the wall of the hollow cylinder 10 which extend along the cylinder axis from above. Pressure springs 25 have been inserted into these blind bores 24 which act on the underside of the head 19 of the piston 9. Thus the piston 9 can be pushed into the hollow cylinder 10 against the force of these pressure springs 25, the sharp edge 13 of the point 12 of the piston completely traversing the transverse aperture 11. The curvature of the edge 13 extends exactly reversed by 90° in respect to the curvature 15 of the transverse aperture 11. So that the piston with its sharp edge 13 remains in this position in relation to the transverse aperture 11, it has a groove 26 in its wall, which extends along the piston axis. The wall of the hollow cylinder 10 is penetrated by a stud screw 27, the tip of which extends into the groove 26 and in this way on the one hand prevents a twisting of the piston 9 in the hollow cylinder 10 and, on the other hand, limits the piston movement in the direction of the piston axis on both sides. Because, as already described, the transverse aperture 11 is curved and the edge 13 of the tip 12 of the piston extends curved in the same way, but turned by in respect to transverse aperture 11, first the tips 14 of the edge 13 strike a fingernail maintained in the transverse aperture 11. Upon further downward pushing of the piston 9, the fingernail is perforated, which is greatly eased by the described curvature of the edge 13, because the active cutting edge of the edge 13 extends at an acute angle in relation to the nail material and an appropriate translation is thus achieved. This means that, per unit of length of the piston displacement, a correspondingly small portion of the hole circumference is cut or punched through. The force required to act on the piston is correspondingly small. If the nail would need to be perforated simultaneously along the entire circumference of the hole, the strength of the fingers would not be sufficient as a rule.

Figure 3:
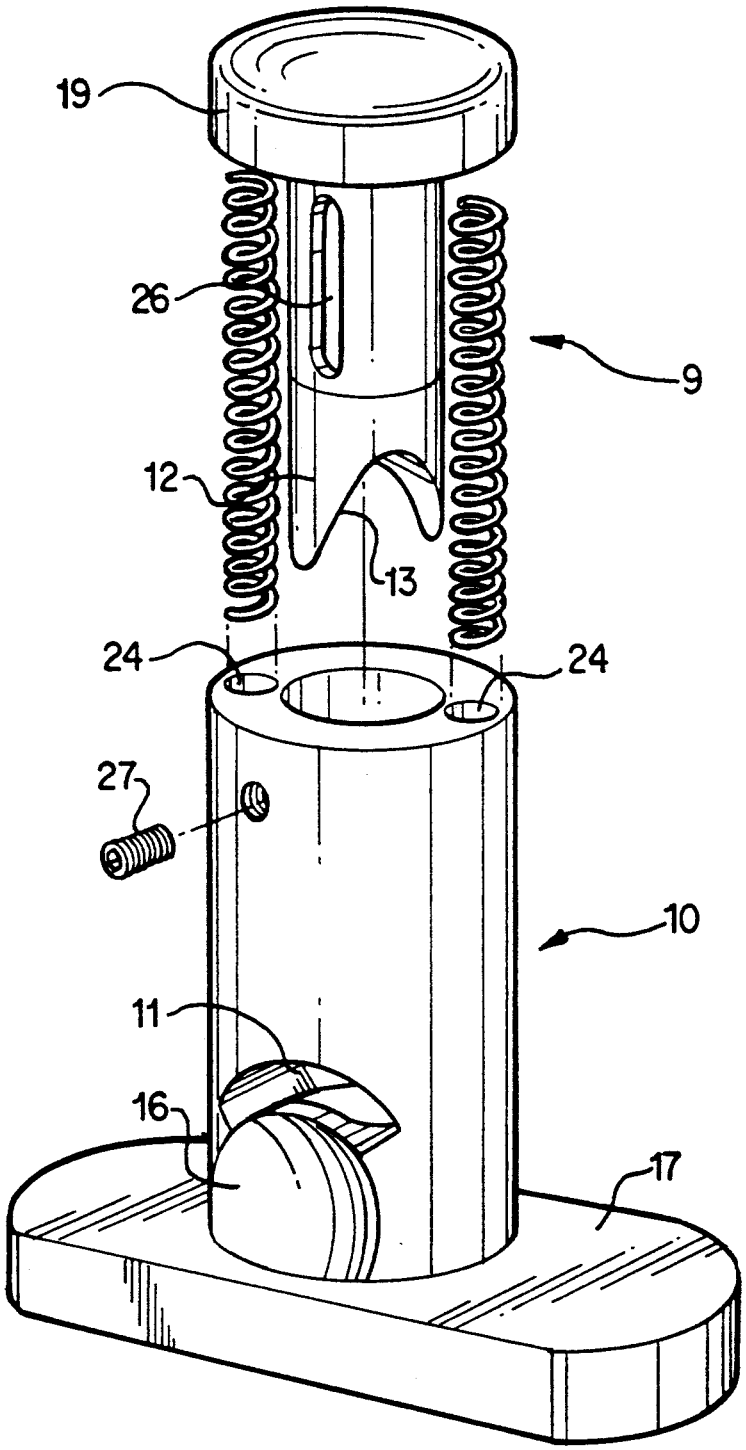
FIG. 3 is an exploded, perspective view; of a perforating device in accordance with the embodiment of this invention shown in FIG. 2.

FIG. 3 illustrates the perforator in a perspective exploded view. This illustration permits a better view of the shaping of the individual parts, in particular of the piston 9 and the hollow cylinder 10. It can be clearly seen how the edge 13 of the tip 12 of the piston, which operates as cutting edge, is shaped. This edge traverses a curve which resembles two connected S-curves. In this way, two rounded tips 14 are formed. The piston 9 is secured by the groove 26 and the stud screw 27 in the hollow cylinder 10 in such a way that the tips 14 of the edge 13 are always located opposite the zenith of the curvature 15 of the transverse aperture 11 in the hollow cylinder. Thus, when the piston 9 is pushed downward and traverses the transverse aperture 11, the edge 13 acts like a pair of scissors together with the edge of the cylinder bore on the surface of curvature 15. The shearing force generated considerably reduces the force needed for punching so that the perforator can be easily operated with one hand. Furthermore, the concave indentation 16 to receive the finger tip of the finger provided with the fingernail to be perforated can be seen on the hollow cylinder 10. The artificial fingernail to be perforated, which has already been glued on the natural one, is pushed into the transverse aperture for perforating until the fingertip rests against the indentation 16. Because of the positioning of the finger in the indentation 16 it is easy to position the fingernail in the transverse hole in such a way that the hole is punched out nicely in the longitudinal center of the nail. It is the object of the curvature 15 that the artificial nail is well set for the purpose of punching, so that a clean cutting edge or punching edge can be created.

Figure 4:
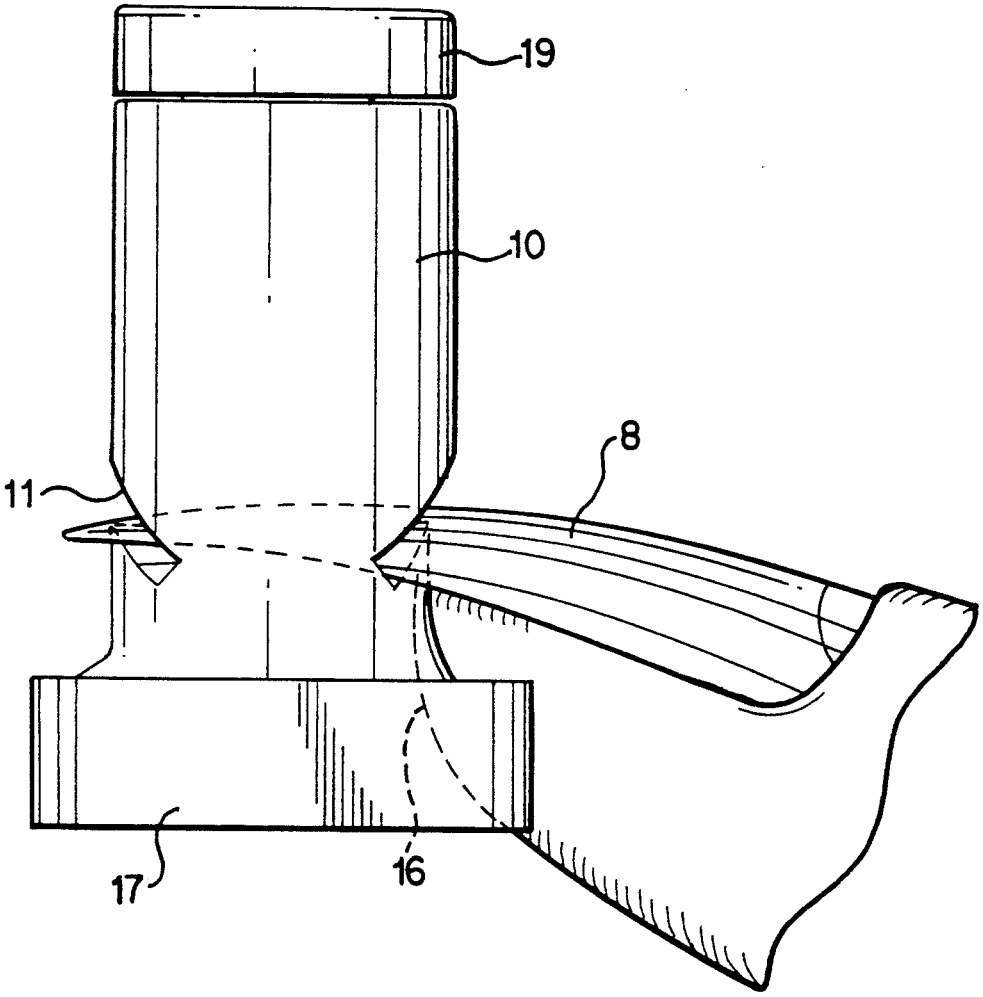
FIG. 4 is a lateral view of the perforating device in accordance with one embodiment of this invention with an artificial fingernail to be perforated in the position of operation.

Finally, FIG. 4 shows the perforator in a lateral view. What has been described above is illustrated here, where a finger with the fingernail 8 to be perforated is placed in the perforator.

Thus, the invention makes possible the perforation in the easiest way of already glued-on artificial fingernails after painting in order to prepare them for receiving an ornamental inset. The perforator is very compact and can be easily carried in a purse, so that it is always available. In spite of its compactness, no great force is needed for punching because of its special construction. The perforator in accordance with the invention therefore also makes it possible for the dainty hands of ladies to make the desired perforations without problems.

I claim:

1. A device for perforating artificial fingernails comprising: a piston-cylinder unit; a wall of a hollow cylinder (10) of said piston-cylinder unit having a transverse aperture (11) which is banana-shaped in cross section, convexly curved in relation to a piston (9) in said piston-cylinder unit, extends through the entire said hollow cylinder (10), and is wider than an interior diameter of the hollow cylinder (10); and a piston tip (12) of the piston (9) having a sharp edge (13) honed into a knife.

2. A device in accordance with claim 1, wherein said sharp edge (13) comprises a curve made of two connected S-curves along a circumference of the piston (9), and an interior of the piston (9) is set back in respect to the sharp edge (13), so that said sharp edge (13) protrudes in an axial direction.

3. A device in accordance with claim 2, wherein the piston (9) is oriented inside the hollow cylinder (10) such that portions of the sharp edge (13) which protrude farthest in an axial direction are located opposite a highest point of the transverse aperture (11) in the wall of hollow cylinder (10) such that when the piston (9) is pushed in, a plurality of edge tips (14) of said sharp edge (13) first traverse the transverse aperture (11).

4. A device in accordance with claim 3, wherein the piston (9) is pushed against a spring force into the hollow cylinder (10), an axial bore of which is continuous.

5. A device in accordance with claim 4, wherein the hollow cylinder (10) has a base (17), which protrudes beyond said hollow cylinder (10) in an axial direction, on an end of said hollow cylinder (10) facing away from the piston (9).

6. A device in accordance with claim 5, wherein the piston (9) has a head (19) which protrudes over the piston (9) in a radial direction on a piston end of said piston (9) facing away from the hollow cylinder (10).

7. A device in accordance with claim 6, wherein at least one blind bore (24) is present in an axial direction in the wall of said hollow cylinder (10), in which a pressure spring (25)having a free end is disposed, said free end acting upon a piston portion of the piston (9) extending from the hollow cylinder (10).

8. A device in accordance with claim 7, wherein the piston (9) is held in the hollow cylinder (10) by a laterally disposed axial groove (26), into which protrudes a screw (27) which extends through the wall of hollow cylinder (10) such that the piston (9) is displaceable inside the hollow cylinder (10) along the axial groove (26) over a length of said axial groove (26).

9. A device in accordance with claim 8, wherein the piston (9), having a separate said piston tip (12), and the hollow cylinder (10) are each made of one piece and entirely of plastic.

10. A device in accordance with claim 8, wherein the piston (9) and the hollow cylinder (10) each have an opposing end having at least one concave indentation (20, 18) suitable for a plurality of fingers (21, 22, 23) to operate the device.

11. A device in accordance with claim 1, wherein the piston (9) is pushed against a spring force into the hollow cylinder (10), an axial bore of which is continuous.

12. A device in accordance with claim 1, wherein the hollow cylinder (10) has a base (17), which protrudes beyond said hollow cylinder (10) in an axial direction, on an end of said hollow cylinder (10) facing away from the piston (9).

13. A device in accordance with claim 1, wherein the piston (9) has a head (19) which protrudes over the piston (9) in a radial direction on a piston end of said piston (9)facing away from the hollow cylinder (10).

14. A device in accordance with claim 1, wherein at least one blind bore (24) is present in an axial direction in the wall of said hollow cylinder (10), in which a pressure spring (25) having a free end is disposed, said free end acting upon a piston portion of the piston (9) extending from the hollow cylinder (10).

15. A device in accordance with claim 1, wherein the piston (9) is held in the hollow cylinder (10) by a laterally disposed axial groove (26), into which protrudes a screw (27) which extends through the wall of hollow cylinder (10) such that the piston (9)is displaceable inside the hollow cylinder (10) along the axial groove (26) over a length of said axial groove (26).

16. A device in accordance with claim 1, wherein the piston (9), having a separate said piston tip (12), and the hollow cylinder (10) are each made of one piece and entirely of plastic.

17. A device in accordance with claim 1, wherein the piston (9) and the hollow cylinder (10) each have an opposing end having at least one concave indentation (20, 18) suitable for a plurality of fingers (21, 22, 23) to operate the device.

18. A device for perforating artificial fingernails comprising: a piston-cylinder unit; a wall of a hollow cylinder (10) of said piston-cylinder unit forming a concave indentation (16) for receiving a fingertip wearing an artificial fingernail (8) to be punched and further forming a transverse aperture (11) immediately above said concave indentation (16) which is banana-shaped in cross section, convexly curved in relation to a piston (9) in said piston-cylinder unit, extends through the entire said hollow cylinder (10), and is wider than an interior diameter of the hollow cylinder (10); a piston tip (12) of the piston (9) having a sharp edge (13)honed into a knife, said sharp edge (13) comprising a curve made of two connected S-curves along a circumference of the piston (9), an interior of the piston (9) set back in respect to the sharp edge (13), whereby said sharp edge (13) protrudes in an axial direction, and the piston (9) oriented inside the hollow cylinder (10) whereby portions of the sharp edge (13) protruding farthest in an axial direction are located opposite a highest point of the transverse aperture (11) in the wall of hollow cylinder (10) such that when the piston (9), is pushed in, two edge tips (14) of said sharp edge (13) first traverse the transverse aperture (11).

19. A device in accordance with claim 18, wherein the piston (9) is pushed against a spring force into the hollow cylinder (10), an axial bore of which is continuous.

20. A device in accordance with claim 18, wherein at least one blind bore (24) is present in an axial direction in the wall of said hollow cylinder (10), in which a pressure spring (25) having a free end is disposed, said free end acting upon a piston portion of the piston (9) extending from the hollow cylinder (10).

* * * * *